US007293893B2

(12) United States Patent
Kim

(10) Patent No.: US 7,293,893 B2
(45) Date of Patent: Nov. 13, 2007

(54) FLASHLIGHT WITH ADJUSTABLE COLOR SELECTOR SWITCH

(75) Inventor: Paul Y. Kim, Irvine, CA (US)

(73) Assignee: Surefire LLC, Fountain Valley, CA (US)

( * ) Notice: Subject to any disclaimer, the term of this patent is extended or adjusted under 35 U.S.C. 154(b) by 24 days.

(21) Appl. No.: 10/955,139

(22) Filed: Sep. 29, 2004

(65) Prior Publication Data

US 2005/0122712 A1 Jun. 9, 2005

Related U.S. Application Data

(63) Continuation-in-part of application No. 10/777,597, filed on Feb. 11, 2004, which is a continuation-in-part of application No. 10/732,883, filed on Dec. 9, 2003.

(51) Int. Cl.
*F21L 4/02* (2006.01)

(52) U.S. Cl. ..... 362/205; 362/184; 362/231

(58) Field of Classification Search ..... 362/184, 362/200, 202, 205, 206, 208, 231, 276, 362, 362/394, 800; 200/60
See application file for complete search history.

(56) References Cited

U.S. PATENT DOCUMENTS 5,909,952 A * 6/1999 Guthrie et al. ..... 362/205
6,000,811 A * 12/1999 Bordak ..... 362/158
6,190,025 B1 * 2/2001 Solinsky ..... 362/394
6,386,730 B1 * 5/2002 Matthews ..... 362/184
6,722,771 B1 * 4/2004 Stephens ..... 362/184
6,793,366 B2 * 9/2004 Chun ..... 362/184
6,808,287 B2 * 10/2004 Lebens et al. ..... 362/184
6,841,941 B2 * 1/2005 Kim et al. ..... 315/86
6,877,876 B1 * 4/2005 Steinhilber ..... 362/188
7,186,000 B2 * 3/2007 Lebens et al. ..... 362/184
7,204,606 B2 * 4/2007 Brass et al. ..... 362/231
2003/0067769 A1 * 4/2003 Gilpin ..... 362/184

* cited by examiner

*Primary Examiner*—Stephen F. Husar
*Assistant Examiner*—Peggy A. Neils
(74) *Attorney, Agent, or Firm*—Bennet K. Langlotz; Langlotz Patent Works, Inc.

(57) ABSTRACT

A flashlight having an elongated body having opposed first and second ends. A first lamp is a high-intensity variable brightness white light source located at the first end. A number of additional lamps are positioned at the first end. The additional lamps include at least two different output wavelengths different from each other and from the first lamp. A first switch on the flashlight selectively operates to select the output wavelength of the flashlight by selectively enabling different lamps based on the condition of the switch. A power storage element and control circuitry are connected to the lamps and to the switch.

23 Claims, 8 Drawing Sheets

FIG. 1
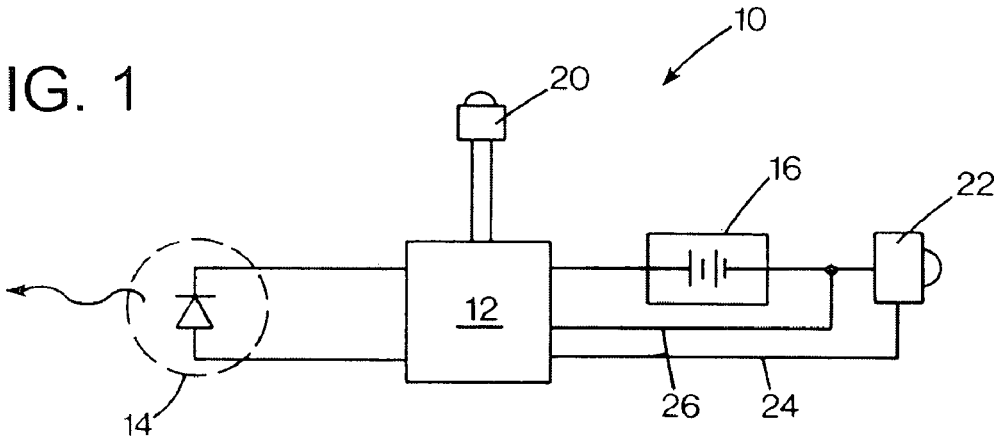
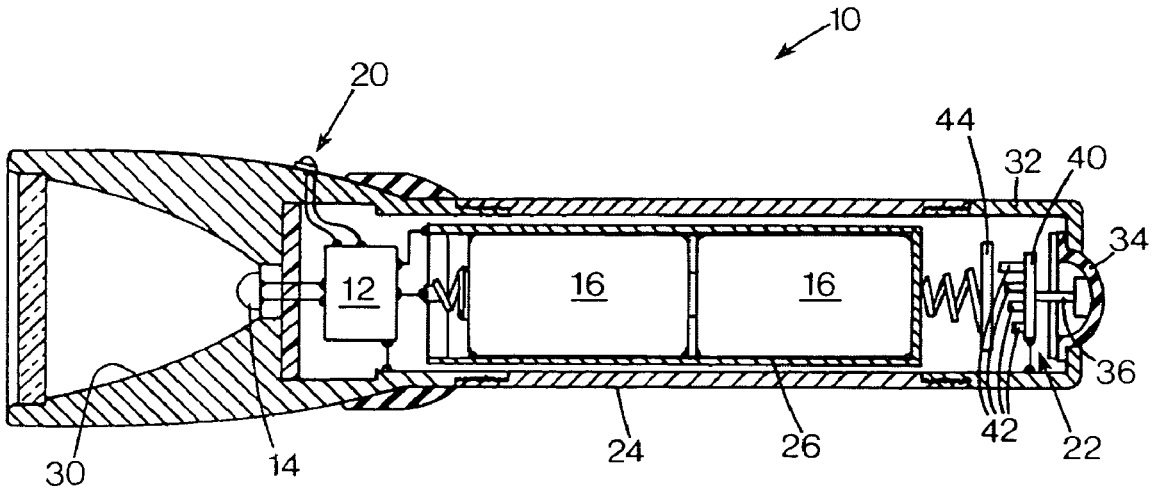
FIG. 2

FIG. 3
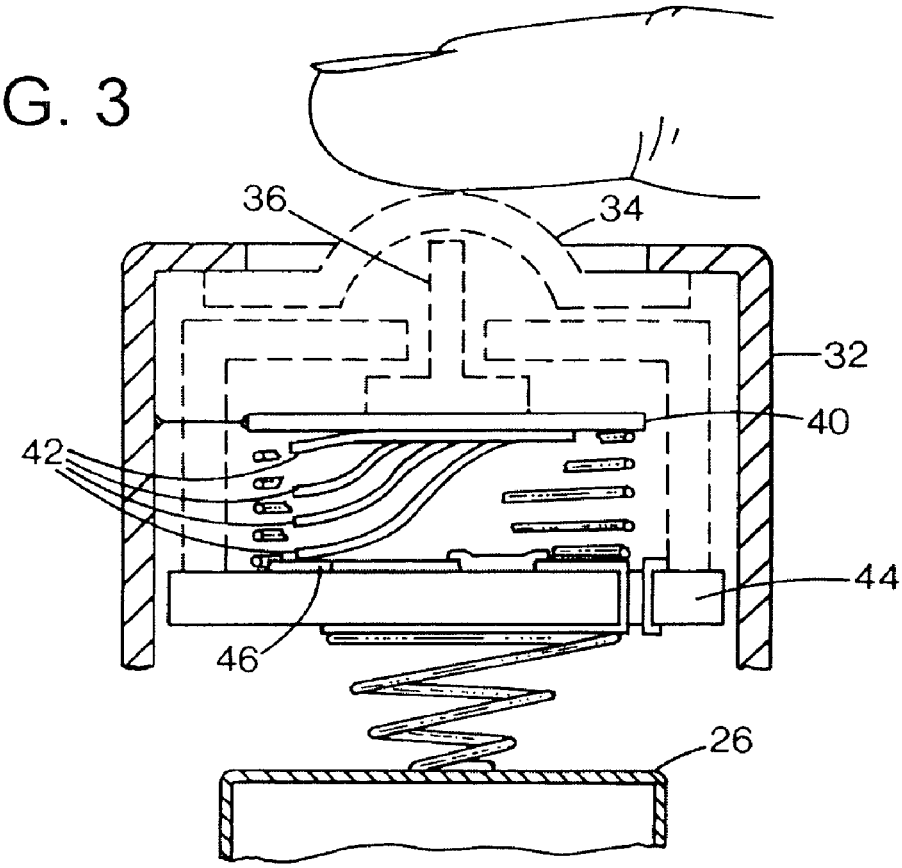
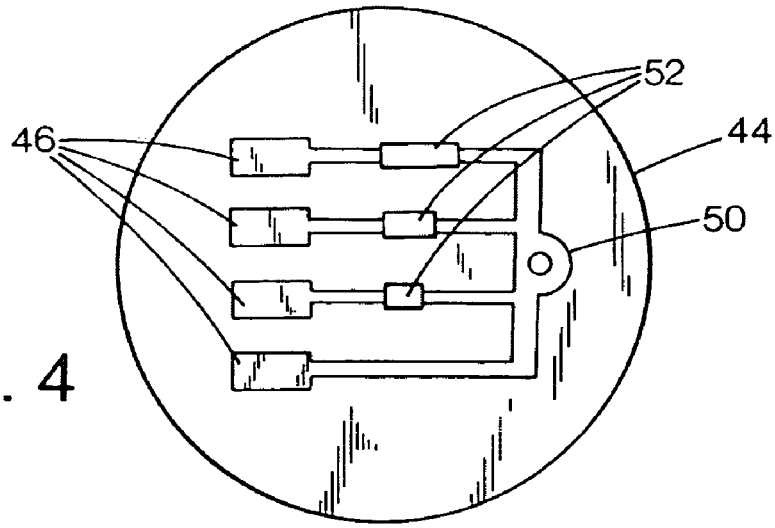
FIG. 4

FIG. 5
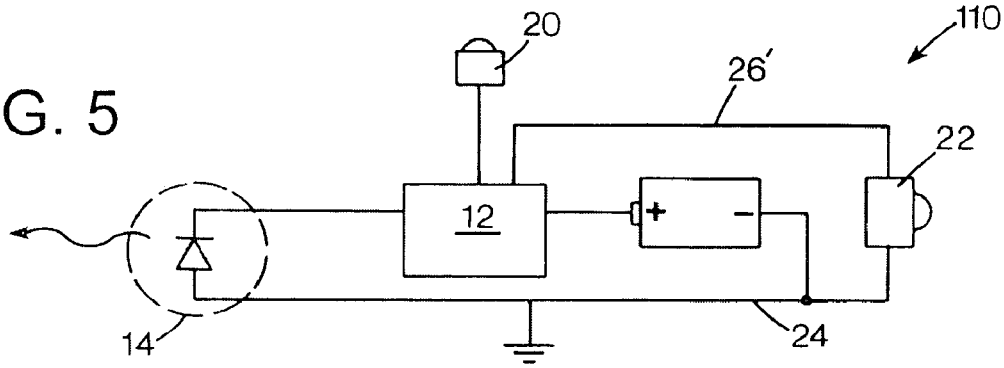
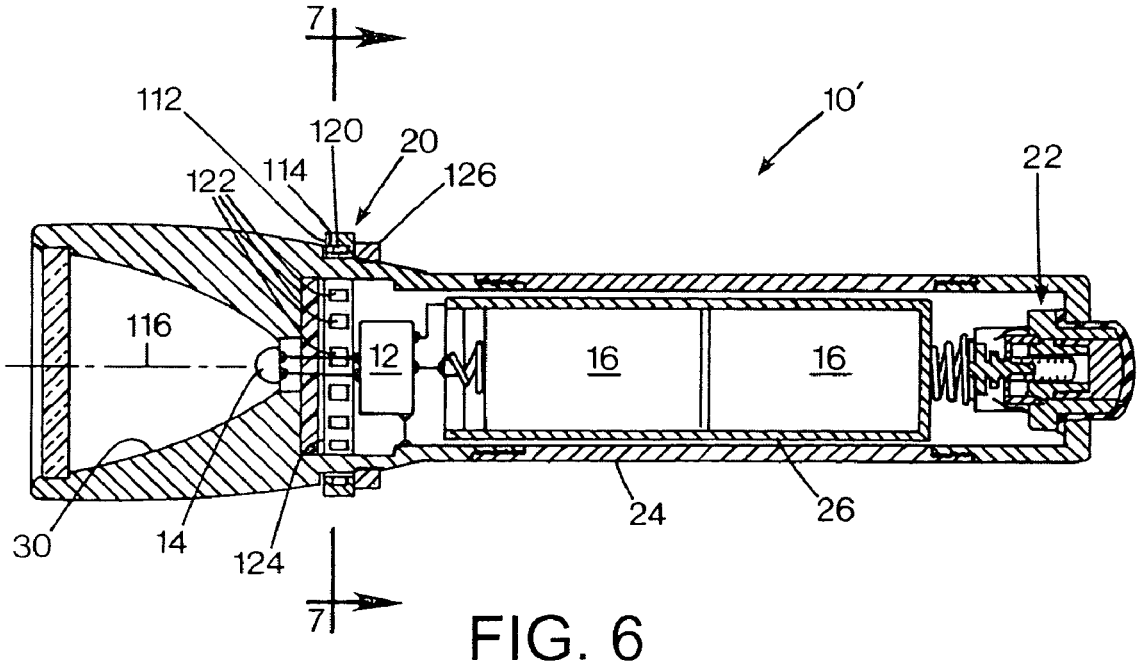
FIG. 6

FLASHLIGHT WITH ADJUSTABLE COLOR SELECTOR SWITCH

REFERENCE TO RELATED APPLICATION

This is a Continuation-In-Part of U.S. patent application Ser. No. 10/777,597, filed Feb. 11, 2004 and entitled Flashlight with Incrementing Brightness Selector Switch, which is a Continuation-In-Part of U.S. patent application Ser. No. 10/732,883, filed Dec. 9, 2003, entitled Flashlight with Selectable Output Level Switching.

FIELD OF THE INVENTION

This invention relates to flashlights, and more particularly to switches for controlling flashlight output.

BACKGROUND OF THE INVENTION

Flashlights are conveniently sized battery powered portable light sources, which provide the user with a source of illumination. Said illumination could be white light or light of a specific color, or even light outside the visible range of wavelengths, such as ultra violet or infrared radiation. The "color" or wave length of the light will depend on the nature of the light source or light sources used in the flashlight. These would typically be either tungsten lamps, ARC lamps, light emitting diodes (LEDs), lasers, or any other emitter.

Because of the general nature of flashlights and their wide range of applications, it is very desirable for a flashlight to be able to emit, at the user's direction, different levels of light output, and/or different colors or wavelengths of light. This can be accomplished using multiple light sources or a single light source, which can be adjusted to provide different levels of light output.

The principal light source used in flashlights is the tungsten filament lamp, as alternatives suffered inadequate illumination, or excessive battery consumption. Tungsten filament lamps, however, cannot be effectively used as a variable output light source because they must be operated close to their design point (current & voltage) if they are to retain their efficiency in converting electrical energy to light. Generally speaking, the same thing can also be said about ARC lamps. Thus, if one wanted two significantly different light outputs from the same flashlight, this would require the use of two different lamps. Examples of such prior art systems are described in Matthews U.S. Pat. No. 5,629,105 and Matthews U.S. Pat. No. 6,386,730, the former teaching the use of a second lamp protruding through the reflector at a point offset to the side of the main lamp which is located at the focal point of the (parabolic) reflector, and the latter teaching the use of two lamps each with its own reflector, the reflectors merged together in a manner such that the light from each lamp interacts only with its own reflector. Both patens are incorporated by reference herein.

In such existing systems, the switching system consists of mechanical contact arrangement where the physical axial displacement of a switch system element (either by direct finger or thumb pressure or by rotation of a tail cap or head of the flashlight) causes first one lamp to be connected to the battery, and additional applied pressure or flashlight element rotation causes the second lamp to be connected to the battery. In some cases the design is such that the first lamp is disconnected when the second lamp is connected to the battery. In other cases, the first lamp remains connected when the second lamp is connected.

In practice, such dual- or multi-source flashlights typically have a pressure switch located on the opposite end of the flashlight from the light source. This switch system, or tail cap, may be rotated through a range of angular positions, each providing a different response to application of a button on the pressure switch. Rotation of the switch on the helical threads connecting it to the flashlight body generates axial movement to move contacts toward or apart from each other. In a first position, the switch contacts are farthest apart, so that full pressure of the button has no effect. This is the "lockout" position. By rotating the switch to the second position, fully pressing the button connects the first lamp to the battery, but not the second (and usually brighter) lamp, which is controlled by more widely spaced contacts that remain locked out. In the third position, which is the position most normally used, moderate pressure on the button first connects the first lamp to the battery; greater pressure, including a "bottoming out" condition then connects the second lamp to the battery. In a fourth rotational position, the first lamp remains on when the button is not pressed and the second lamp is connected in response to additional pressure on the button or to additional rotation of the tail cap. In a fifth rotational position both lamps are connected without the application of any pressure on the button.

While effective, such dual-source lights have several limitations. First, they require the user either to maintain button pressure throughout illumination, or to rotate a switch between operating modes. This requires either continuous use of one hand, or the occasional use of both hands (to rotate the switch), either of which may be disadvantageous for critical military and law enforcement applications.

When set to certain switch modes existing lights do not enable rapid illumination for emergencies. When in the lockout mode or the second mode noted above, maximum pressure will not illuminate the brighter lamp. Changing modes takes time, and requires two hands, which may be disadvantageous in an emergency.

Existing lights have limited choice of light levels. Many tasks require different illumination levels. The moderate level of illumination provided by the first lamp (LED) for many tasks such as camping and ordinary trail navigation may be much brighter than would be desired for map reading in critical military situations. Other applications may require still different moderate lights levels when the full brightness (and shorter run time) of an incandescent lamp is not suitable. Moreover, there is a substantial range of possibly desired brightness levels between the maximum of the first lamp and the full brightness of the second lamp that are not obtainable.

Some existing flashlights employ multiple lamps and a single switch that incrementally illuminates a different number of the lamps to provide different brightness levels. For example, one existing flashlight (has a central incandescent bulb, and several surrounding LED lamps. A single switch cycles the light through several phases: off, some LEDs on, all LEDs on, all lamps on including LEDs and incandescent lamp. The switch is a mechanical push-button switch that indexes in sequence through these states as the button is clicked (push-release). The switch has a rotating element that contacts a different contact in each state, and each such contact is connected to include the selected lamps in the circuit. Such lights provide different output levels, but have the disadvantages of complexity, in addition to optical compromises caused by the different lamps having less-than-optimal beam spreads due to the need to locate some away from the focus of a primary reflector, and due to the inherent "shadowing" of the beam of one lamp by other lamps intervening in the beam path. Moreover, coordinating and aligning the beam patterns of multiple lamps that operate simultaneously can present additional manufacturing challenges.

Another disadvantage of existing lights is that they offer limited color output options. Typically, a white tungsten light may be provided with different color filters, which may be lost or damaged, and which are cumbersome. LED flashlights may employ a selected color for a selected application, although these lack versatility and require a number of different lights in order to perform for different applications.

One successful multi-color flashlight employs a bright central tungsten lamp in conjunction with several LEDs of a different brightness or color. This operates to illuminate the LEDs when a button is pressed with moderate pressure (or rotation of a tail cap by a limited amount) and to illuminate the intense central light when the switch is fully depressed (or the tail cap fully rotated.) While effective for certain applications, this light is limited to only two output conditions, and is incapable of more that two different colors of light, or color in addition to more than one white light brightness level.

It should be noted that the term "lamp" is used in its most general meaning, namely that of any light source (which could be a tungsten filament lamp, an LED, or an ARC Lamp) of any wavelength.

SUMMARY OF THE INVENTION

The present invention overcomes the limitations of the prior art by providing a flashlight having an elongated body having opposed first and second ends. A first lamp is a high-intensity variable brightness white light source located at the first end. A number of additional lamps are positioned at the first end. The additional lamps include at least two different output wavelengths different from each other and from the first lamp. A first switch on the flashlight selectively operates to select the output wavelength of the flashlight by selectively enabling different lamps based on the condition of the switch. A power storage element and control circuitry are connected to the lamps and to the switch.

BRIEF DESCRIPTION OF THE DRAWINGS

FIG. 1 is a simplified block diagram of a flashlight according to a preferred embodiment of the invention.

FIG. 2 is a sectional view of the flashlight of FIG. 1.

FIG. 3 is an enlarged sectional side view of the switch assembly of the flashlight of FIG. 1.

FIG. 4 is an enlarged plan view of a switch assembly component of the flashlight of FIG. 1.

FIG. 5 is a simplified block diagram of a flashlight according to an alternative embodiment of the invention.

FIG. 6 is a sectional view of a flashlight according to an alternative embodiment of the invention.

DETAILED DESCRIPTION OF A PREFERRED EMBODIMENT

Figure 8:
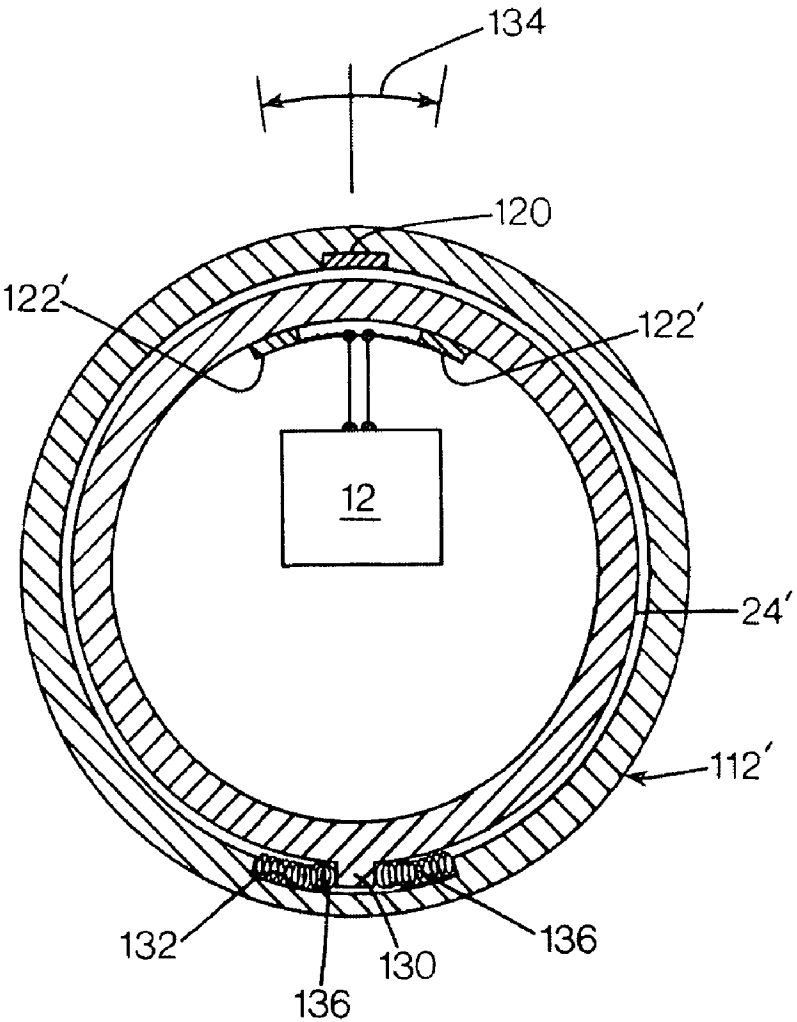
FIG. 8 is an axial sectional view of the dimmer switch mechanism of a further alternative embodiment of the invention.

FIG. 1 shows a schematic drawing of a flashlight 10 according to a preferred embodiment of the invention. The flashlight includes a micro-processor control circuit 12 that is directly connected to a lamp 14, battery 16, dimmed level control selector 20, and operation switch 22.

The lamp 14 is preferably a light-emitting diode (LED), and may be a single lamp that operates efficiently over a wide range of input power to produce a wide range of possible light outputs. In alternative embodiments, there may be multiple light sources, either interconnected to provide a single, switchable (and dimmable) array, with all sources operating in the same manner. In other alternatives, there may be separate lamps or independently controllable lamp elements, so that color hue changes may be obtained by operating different color components in different combinations, or so that dimming control may be obtained by illuminating a different number of the components. The lamp may be an alternative light source, such as a tungsten halogen lamp or any other light source, although LED lamps are believed best suited to presently provide efficiency over a wide range of powers and brightness.

The dimmed level selector 20 may be of any type to provide the operator with the means to select a "dim" brightness level at any intermediate level within the range of the lamp's capability. The dimmed level selector is shown as connected directly to the controller 12, although in alternative embodiments the dimmed level selector may communicate with the controller by other means, including magnetic or radio frequency means. For instance, a rotatable ring may have one or more magnets, and the interior of the flashlight may contain a hall effect sensor connected to the controller to sense position or movement of the ring.

The dimmed level selector may have a selector element such as a dial or slider that establishes a dimmed level based on its position. Alternatively, the selector may establish a dimmed level by responding to the operator's duration (or magnitude) of pressure on a switch, such as by gradually rising in brightness in response to actuation until the selector is released. A dimmed level may be set by numerous alternative means, including by operation of the primary control switch 22, such as by its rotational position, by a series or sequence of impulses, or by any other means.

The flashlight 10 includes a conductive housing that is illustrated schematically in FIG. 1 by a ground bus line 24 extending between a battery electrode and switch lead, and the controller 12. As will be discussed below, the housing is a cylindrical tube defining a bore closely receiving one or more cylindrical batteries 16. Thus, it provides a single electrical path from the switch 22 at the rear end of the flashlight, and the controller 12 at the front end.

A second electrical path is provided over the length of the flashlight by the conductive sleeve element 26 shown schematically here, and detailed below. The sleeve is electrically isolated from the housing, and connects at its closed rear end to the rear of the battery 16 and to a contact from the switch 22, and at its open front edge to the lamp 14 and to the controller 12. The sleeve may be replaced in alternative embodiments by a single conductor wire or circuit element such as a flex circuit to provide the same function. Other alternatives include a conductive trace applied to the interior of the housing (isolated therefrom by an insulating film layer) and connected at each end to the appropriate components. The batteries themselves provide a third electrical path.

The second path provided by the sleeve allows the switch to connect with the controller over two paths, so that the controller may detect a resistance presented by the switch to determine its state, as will be discussed below. The second path further ensures that the switch is not serially connected in the loop with the primary current flow from the battery to the lamp, avoiding parasitic losses due to switch resistance.

FIG. 2 shows the physical structure of the preferred embodiment, with a lens 30 forward of the lamp 14. The housing is has several essentially cylindrical portions defining a chamber for containing the lens, lamp, controller 12, batteries, and switch 22. The dimmer level control 20 is shown in simplified form, and may take any form including a ring rotatable about the housing. The switch (shown in simplified form) is contained within a tail cap 32 having an elastomeric flexible dome 34 covering a switch actuator 36. The switch has a movable portion 40 having several contacts 42 each connected to the housing ground. The movable portion reciprocates axially with respect to a fixed switch portion 44 connected to the conductive sleeve 26.

As shown in FIG. 3, the contacts 42 of the movable portion 40 are leaf springs, each extending a different distance from a base panel that is connected to the housing ground. The switch show in FIGS. 2 and 3 is simplified for clarity of the principles of its operation. The actual switch of the preferred embodiment is configured like existing such switches that allow a bi-level operation. Such switches have the contacts arranged in arcs or annuluses to allow the switch to function when the tail cap is rotated through a range of positions. The preferred embodiment would have its contacts configured as such, although this would unduly complicate the illustrations, which are shown in schematic form.

All the leaf spring contacts are connected to each other. As the switch is depressed over its range of axial travel, the contacts contact the fixed element 44 in sequence. As shown in FIG. 4, the fixed element includes an array of pads 46, each positioned to be contacted by a respective end of a leaf spring contact 42. The pads are all connected to a node 50 that connects via a plated through-hole or other means to the opposite side of the element, which thereby connects to the sleeve 26. Each pad 46 connects to the node 50 with a different intervening resistance. Several resistors 52 are provided to intervene between the various pads and the node.

Before the switch button is depressed, the resistance between the fixed portion (and thereby the controller's connection to the sleeve) and the movable portion (and thereby the controller's connection to the housing ground) is infinite. When the button is slightly depressed, a first leaf spring contact makes contact with a pad associated with a resistor. The controller may thus determine by this resistance across these lines that the button has been pressed to an intermediate position. In the preferred embodiment, the controller then operates the lamp at the pre-selected dimmed illumination level.

When the button is further depressed, another leaf spring contacts a pad. In the simplest case, the switch has only two contacts (not the four illustrated), and the second contact would contact a pad having no resistor. This reflects a condition when the switch is fully depressed, and would cause the controller to provide full brightness illumination. In the more complex embodiment illustrated, there are five button states (including the released condition) determinable by the controller, so that various brightness levels or preselected dimmed or hue outputs might be provided based on the switch condition. The preferred embodiment requires at least two different contacts that make contact at different depression amounts of the button, and are connected to at least one resistor to provide a different output resistance depending on whether one, both, or neither are making contact. In the simple case, one extending spring contact may protrude, with the moving element panel 44 making direct contact in the fully actuated position.

By having an electronic controller connected to the switch, additional switching and control capabilities may be provided that are not provided by a conventional switch in line with the power loop. The illumination of the lamp need not correspond to the position of the switch. This enables a "click-on, click-off" switch mode in which a momentary actuation of the switch causes sustained illumination, and a second momentary actuation ceases illumination. This function is provided in the absence of a conventional mechanical switch that switches between open and closed contact positions using springs and ratcheting mechanisms, in the manner of a ballpoint pen or other conventional on-off flashlight switches.

By electronic control of switching operations, significant additional capabilities are made available. The controller may detect the duration of pressure on the button, the magnitude of pressure (for embodiments with multiple leaf springs for at least one intermediate actuated position), and the number and pattern of actuations (enabling distinguishing of commands in the manner of a single or multiple click computer mouse.)

In the preferred embodiment, the tail cap 32 may be unscrewed from the housing a sufficient amount to prevent any switch contacts from making contact even when the button is fully pressed, providing a lockout position for storage to prevent inadvertent discharge of batteries or unwanted illumination during critical operations.

For normal operation, the tail cap is screwed tightly to the scope body to an "operational condition." This differs from conventional flashlights that require the tail cap to be in an intermediate rotational position for selective operation (full screw-down providing constant-on operation in such lights.) This reduces potential operator error, and avoids the need for testing operational condition to ensure proper rotational position in advance of a critical operation, or after replacement of batteries.

When in the operational condition, displacement of the button to a first intermediate position (or intermediate pressure, for strain gauge buttons) causes the controller to provide power to the lamp for illumination at a pre-selected dimmed level, but only while the button is displaced. This provides momentary illumination, or a "dead man's" capability, so that the light turns off when pressure is ceased.

Displacement to a second intermediate position (such as when a second leaf spring makes contact in the switch, so that the controller detects a different resistance level) causes the controller to operate the lamp at the same pre-selected dimmed level, but with sustained operation upon release of the button. The switch may include a mechanical detent mechanism to provide tactile feedback to the operator to indicate that sustained illumination will be provided, or the rubber boot on the tail cap button may be designed with an over-center operation characteristic that provides a distinctive tactile feel when pressure beyond the required level to reach the second intermediate position is provided. In alternative embodiments, feedback devices may include electronic transducers in the flashlight connected to the controller, such as an audio annunciator that provides a "click" sound, or tactile transducers such as piezoelectric devices that provide a tactile response.

When illuminated at the preselected dimmed level, any pressure of the button less than the second intermediate position has no effect, while pressure beyond the threshold that led to sustained illumination and release beyond the first intermediate level will cease illumination.

When in the off condition, or when illuminated at the preselected dimmed level, displacement of the switch beyond the second intermediate level to a third or maximum level causes the controller to provide maximum illumination in a "panic" mode. In the preferred embodiment, full pressure on the switch generally causes sustained illumination at the maximum illumination level. To avoid unintended max illumination when a user intending to "click on" at the preselected dimmed level inadvertently presses momentarily with excessive force to the third level, the controller is programmed to provide sustained max illumination only when the contact at the third level is made for more than a brief pre-selected duration. In such an embodiment, the momentary click by a user to invoke the pre-set dimmed level may result in a momentary flash at the max brightness level, but this ensures that users requiring max brightness receive immediate illumination. In an alternative embodiment where immediate max illumination is not critical, the controller may be programmed to delay max illumination until after the button has been depressed more than the momentary threshold, avoiding the max flask when intermediate lighting is desired. In such an embodiment, maximum output is slightly delayed to ensure at least slightly sustained duration of pressure more than the fraction of a second that would correspond to accidental excess pressure.

From the maximum illumination condition, pressure on the switch beyond the third displacement amount and release of pressure will cease illumination. The controller may be programmed to return from the max illumination to the preselected dimmed level based on whether the light was operating in the preselected level when the max illumination was initiated. The controller may alternatively be programmed to select an illumination condition upon cessation of max illumination based on the degree of switch actuation, such as by turning off after pressure to (and release from) the third level, and by switching to the preselected level after pressure to (and release from) the second level.

In alternative embodiments, the capability to detect switch application duration enables significant flexibility of function. For instance, the max brightness operation may be established as either sustained or momentary based on duration of application beyond the first brief time threshold set to avoid intended max illumination as discussed above. For switch pressure sustained longer than a second threshold greater than the first, the controller provides momentary max illumination only during such pressure. For pressure more than the first duration but less than the second (such as a deliberate but brief application) the action is read by the controller as a "click on" command.

The programmability and flexibility of the switch control provides further advantages in alternative embodiments. Programming may be fixed, or customized based on institutional purchaser requirements, or programmed on an individual basis by each operator. Some applications will prefer programming that avoids accidental max illumination (such as for infantry troops operating at night), while other applications will prefer ready access to max illumination without delay or difficulty (such as for police work.)

The programmable capability of the controller with the electronic switch will provide the user (or a service agency) the capability to re-program the operating characteristics of the device. For instance, where a second dim-level control switch is not desired, the user may invoke a programming mode by a selected sequence of switch actuations. This may be a sequence of pressures to different degrees, a sequence of a number of clicks, or a sequence of clicks of different durations, such as Morse code. Once in a selected programming mode, pressure on the switch may cause the light level to ramp up gradually, so that the user sets the preselected dimmed level by releasing the switch when the dimmed level is desired. Such a mode might be invoked by a simple double click of the switch.

For a flashlight having more than one different light source, such as having multiple colors, the user may program the color (or invisible wavelength) to be output at different modes. This may include selecting hue based on which of several different color lamps (such as RGB LEDs) are illuminated, and in what relative brightnesses. The ability to record and store sequences of different durations also permits the storage of messages (such as entered by Morse code) and subsequent transmission in a regulated format that is readily receivable by other electronic devices. With the fast response time of LED lamps relative to incandescent, such messages may be "hidden" during flashlight operation (in visible or infrared wavelengths) as brief, possibly imperceptible variations of the output level.

The controller may be of any conventional type, programmed and programmable for the various functions above, the circuitry includes a power switching device such as a FET that operates to provide a selected power level to the lamp(s) based on the controller input.

FIG. 5 shows an alternative circuit block diagram of a flashlight 110 having the same capabilities at that illustrated in FIG. 1, but with the sleeve (or alternate second conductive path) 26' being connected only between the switch and the controller, so that the battery power loop passes through the housing ground 24. This may be suitable for applications in which the second conductive path 26' has a high resistance, or low current carrying capability.

While the above is discussed in terms of preferred and alternative embodiments, the invention is not intended to be so limited. For instance, many of the above functions and features of a programmable controller may be provided my other means, and the interface between the switch (which may be located at any position) and the controller need not be hard-wired, but may include data transmitted by radio frequencies emitted by the switch and received by the controller. Alternatively, communication may be provided by optical means, such as by an infrared emitter on the switch and a corresponding detector associated with the controller. Such optical communication may be made by line of sight in a passage adjacent to the batteries within the tube, through an optical conduit such as a fiber, or through a housing member having optically transmissive qualities.

Alternative Embodiment

FIG. 6 shows a flashlight 10' that is essentially the same as that shown in FIG. 1, except that it has a dimmer control 20' in the form of an annular ring 112 that is received in a channel 114 defined about the periphery of the flashlight's housing 24 at the forward portion that houses the lamp 14.

The ring and channel are oriented in a plane perpendicular to the flashlight housing and optical axis 116, and are concentric with the cylindrical housing portion. The ring includes an embedded magnet 120 facing toward the center of the ring. The flashlight includes a plurality of Hall effect magnetic field sensors 122 that operate to detect whether or not the magnet is adjacently positioned. The sensors are connected to the control circuit 12, which receives a signal to determine the angular position of the ring at any time.

Figure 7:
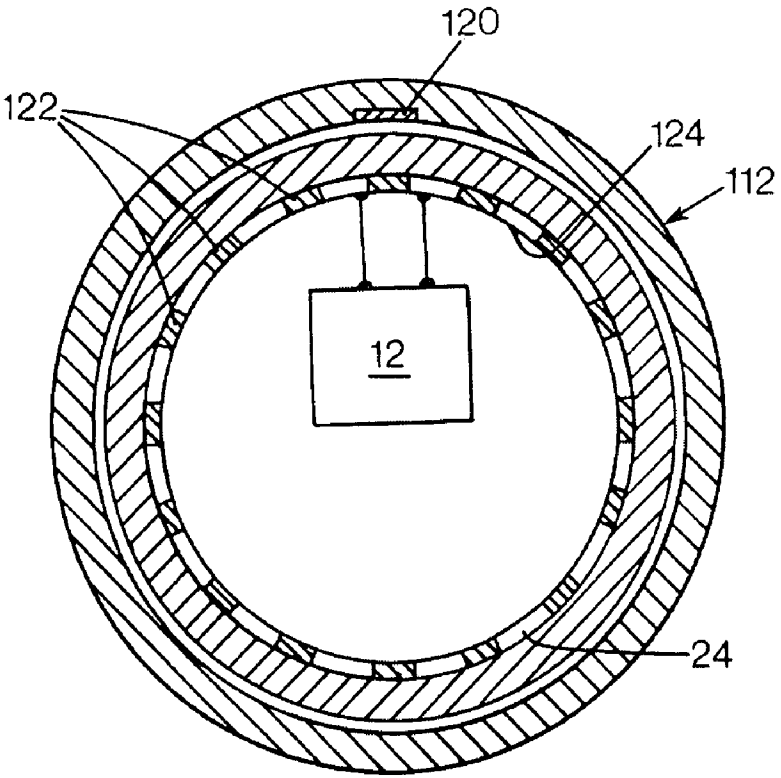
FIG. 7 is an axial sectional view of the dimmer switch mechanism of the embodiment of FIG. 6 taken along line 7-7.

The sensors 122 may be embedded in the housing, such as embodiments in which the housing is molded plastic; in the preferred embodiment, the sensors 122 are attached to a flexible circuit element 124 as shown. As shown in FIG. 7, the flex circuit encircles the interior chamber of the housing, against the outer wall adjacent to the channel 114. The circuit includes between 6 and 20 sensors, which are interconnected to the control circuit. (This number may vary beyond this range for other applications. With this arrangement, the control circuit operates to detect the absolute position of the ring.

Referring back to FIG. 6, the housing's forward bezel portion includes a threaded ring 126 that engages threads on the housing to provide one shoulder or wall of the channel, With the threaded ring being separable from the housing, installation and removal of the switch ring 112 is permitted. Although not shown, a friction device such as a rubber O-ring, felt pad, or spring biased detent may be provided to prevent the ring 112 from turning unintentionally, so that a definite amount of torque is required to change the dime level, avoiding inadvertent changes.

The ring 112 serves to allow the user to establish a state for operation of the flashlight, within a range of discreet options corresponding to the number of sensors 122. In the preferred embodiment, the ring establishes a power or dimmed level for the output of the lamp when the tail cap switch is in an intermediate position or has otherwise been operated to indicate a selected intermediate brightness level. The user may rotate the ring in advance or operation, setting the ring to a known number or other indicia printed on the housing and ring. Alternatively, the user may trigger the intermediate dimmed illumination mode by any of the means noted above, and rotate the ring until a satisfactory brightness is achieved.

Figure 10:
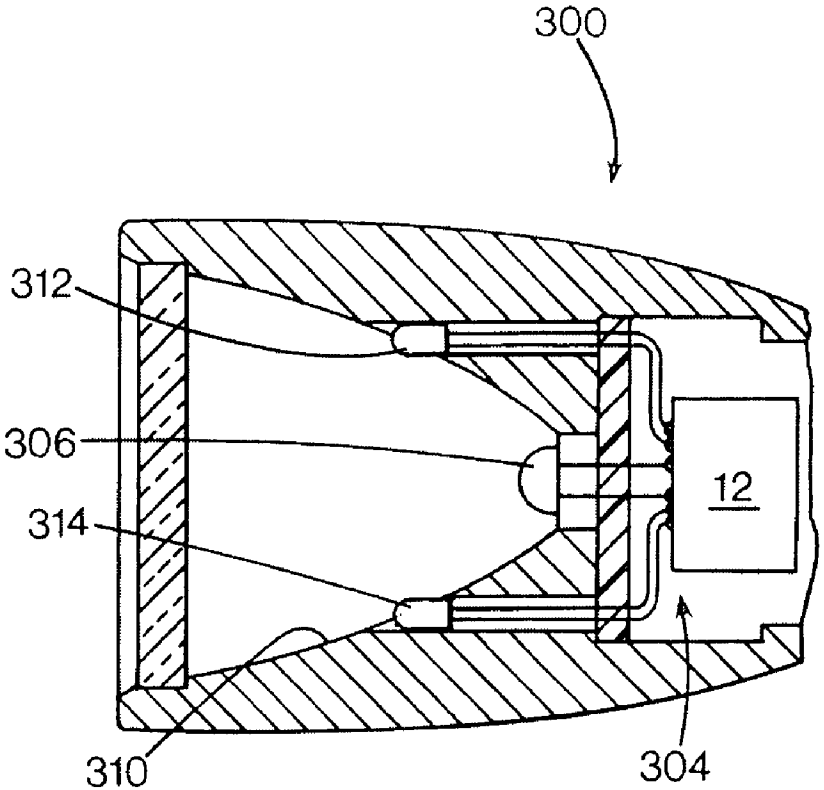
FIGS. 9 and 10 illustrate alternative multiple color lamp alternatives.

In alternative embodiments, the rings may be used to set a second brightness level, such as the maximum level, by rotating to a selected position when the light is illuminated in the maximum mode. The flexibility offered by the control circuit and switches further allows for the setting of any number of brightness levels, which may be achieved by various combinations of inputs related to those noted above with respect to the preferred embodiment, including multiple clicks, and inputs of different durations. The dimmer switch ring may further be used to establish a color output, such as with lamps having variable or different color lamps (as will be illustrated in FIGS. 9 and 10) so that the position of the ring determines which lamp or lamps are illuminated, and in which combination. The light may also be provided with an additional mode that prevents unexpected overbright operation that would reveal a military position or impair night vision by always reverting to the dimmest level until the switch ring 112 is repositioned to a selected brightness level.

FIG. 8 shows an alternative embodiment dimmed level switch ring 112' in which the dimmed level is based not on the absolute position of the ring, but is adjusted by momentarily imparting slight rotation to the ring 112'. In this embodiment, the housing 24' includes a protruding key 130 in the channel. The ring 112' has a corresponding slot 132 that receives the key. Because the slot is of limited length, the rotation of the ring is limited as the key abuts the ends of the slot at the extremes of travel. This limits angular displacement as indicated by angle 134. The ring is spring biased to a neutral position, as schematically indicated by springs 136. The ring includes a magnet 120, which activates Hall effect sensors 122' that are positioned for activation at the respective limits of rotation. Thus, the controller can detect three different states: first, when the ring is released and at the neutral position, providing no response from either sensor, or when either sensor is triggered by full rotation of the ring to a respective extreme direction.

The FIG. 8 embodiment operates by the control circuit 12 maintaining a selected dimmed level state in memory, and incrementing that state upward or downward by a degree based on the duration the ring is held at a respective limit position. As with the FIG. 7 embodiment, this may be done while the light is illuminated, but may alternatively be done while the light is off, such as by using indicator lights or a display (not shown) to indicate the selected dimmed brightness level. The level may be set by a series of brief impulses in either direction, each incrementing the dimmed level by a nominal amount. This alternative interface may be used to achieve all of the functions as with the FIG. 7 embodiment, including color selection and entry of data and programming codes.

Figure 9:
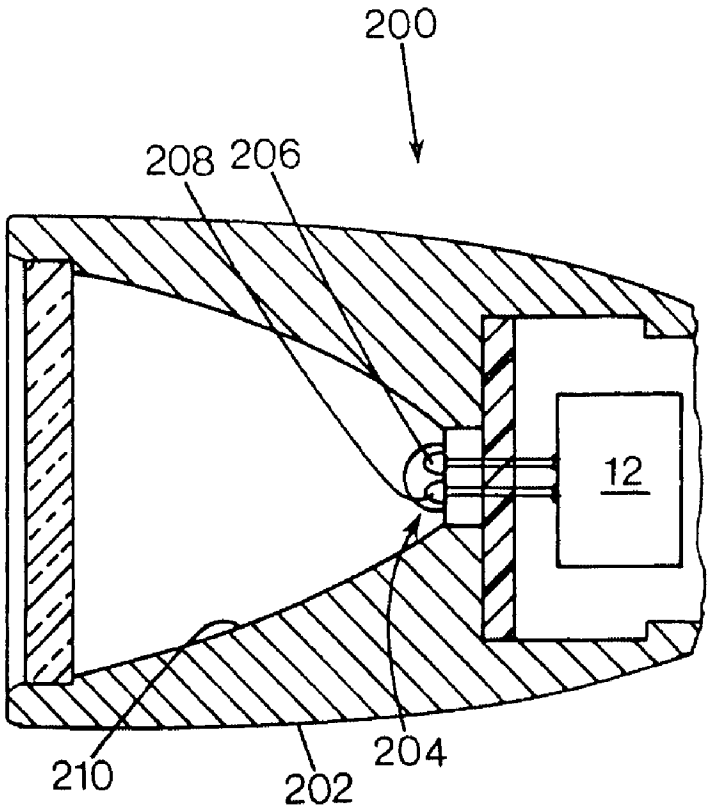

FIG. 9 shows a flashlight 200 having an alternative lamp arrangement for multiple color operation. The flashlight has a housing 202 containing a lamp assembly 204 having more than one different color LED 206, 208 at or near the focus of a primary lens 210. This may include more than two LEDs, to provide a full spectrum of color, such as by providing red, blue, and green LEDs. An infrared or other non-visible emitter may also be included. The FIG. 10 embodiment shows a further alternative light 300 having a housing 302 containing a lamp assembly 304 having a first lamp such as a bright white LED 306 at the primary focus of a reflector 310, with separate LED lamps 312, 314 of different colors having integral lenses and penetrating apertures in the housing. This may be useful for the full color spectrum option noted above, as well as other approaches that use the primary source for a bright beam providing maximum brightness, and the other lamps for specialized uses, such as a red LED for night vision preservation. For instance the tail cap switch may provide illumination of a red led with slight pressure, illumination of the main lamp to a dimmed level with greater pressure, and max illumination of the lamp with full pressure.

Incrementing Switch Embodiment

Figure 11:
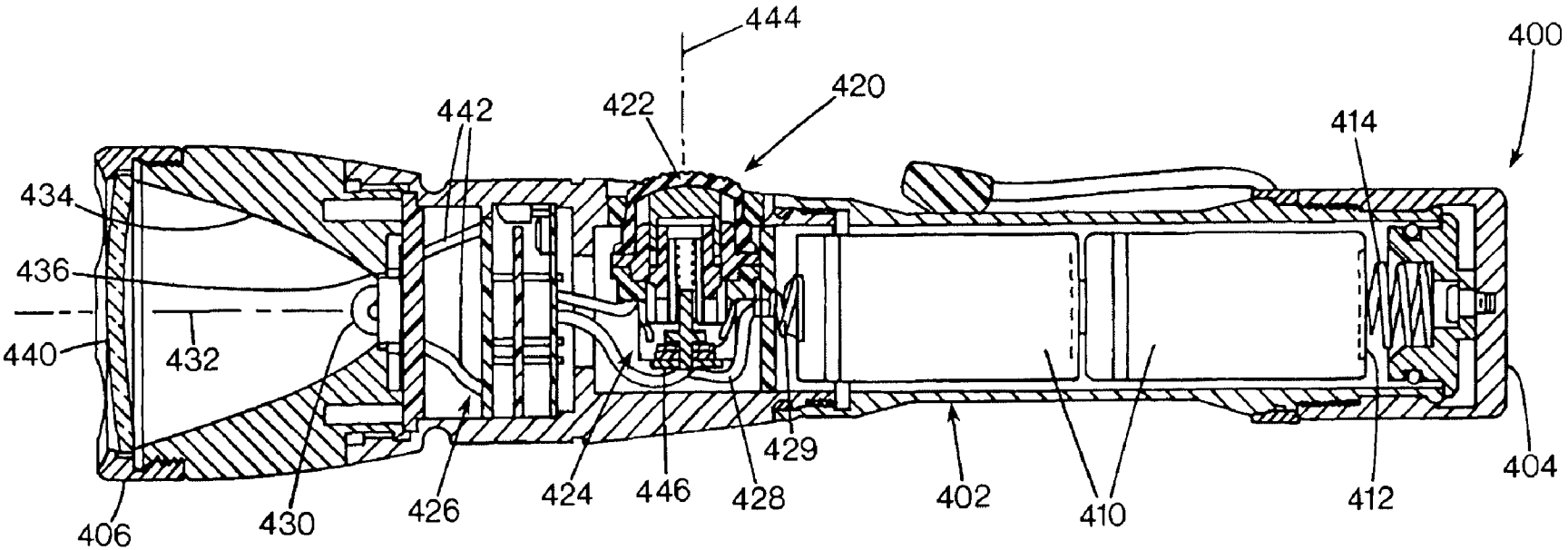
FIG. 11 is a sectional side view of a flashlight according to an alternative embodiment of the invention.

FIG. 11 shows a flashlight 400 with an elongated cylindrical housing 402 having a threaded tail cap 404 at one end, and a bezel 406 at the opposite end. A number of batteries 410 providing a power source are positioned within the housing near the tail cap, with the rear contact 412 of the rear battery contacting a spring 414 on the tail cap. The spring is connected electrically to the tail cap and housing, which are metallic to conduct electricity and form a ground to enable operation.

A switch 420 is positioned just forward of the batteries toward the front or bezel end of the flashlight. In an alternative embodiment, the switch may be positioned at the tail cap, with otherwise identical operation. The switch includes an external actuator 422 for activation by a user's fingertip, and an mechanism 424 contained within the housing and to be discussed in greater detail below. An electrical controller 426 is positioned within the housing forward of the switch, and includes a number of circuit boards that are interconnected, and to which are mounted discrete and integrated electrical components to provide the disclosed functionality. The controller includes a ground line connected to the housing, and a power line 428 connected to a forward battery terminal 429.

The forward portion of the flashlight includes an LED lamp 430 centered on an optical axis 432 defined by the body of the flashlight. A reflector 434 is a paraboloid or other surface of revolution about the axis, and has an aperture 436 through which the LED lamp protrudes. A lens 440 encloses the forward end of the reflector. The reflector is unbroken by any other elements or penetrations, so that the LED's light output is fully reflected in a generally forward direction without shadows or other blockages. The LED has a pair of leads 442 connecting the electrodes of the LED to the controller 426.

The switch 424 is a conventional push-button switch used for other applications. The preferred switch is Torch Switch model P54-4 from Rainbow Production Company (www.switch.com.hk) of Hong Kong. The switch has a push-button actuator 422 that operates axially in response to pressure by a user, with the switch axis 444 perpendicular to the flashlight housing axis 432. The switch operates with a "click" motion, so that it provides a tactile feedback when depressed, and returns to its resting position immediately upon cessation of the pressure. In response to each click, an internal mechanism rotates a spindle 446 about the switch axis 444 by a fraction of a full rotation. In the illustrated embodiment, the spindle has five positions, so that each incremental rotation is one fifth of a rotation or 72 degrees. In each of the five rotational positions of the spindle, and switch may be described as having a different electrical state. The state of the switch is electrically conveyed to the controller as will be discussed below with respect to FIG. 12, with contacts on the switch being interconnected differently in each state.

As the switch is clicked, it proceeds through the states in a given sequence that may not be reversed. The states may not be accessed out of sequence. Each state corresponds to a selected light output level, and the controller is configured and or programmed to respond to each state by delivering a selected amount of power to the LED. In a first state, no power is delivered, and the light is off. In the next state, a limited amount of power is delivered. In each successive state, more power is delivered, until the final state, in which the maximum amount of power is delivered for maximum light output. From this fifth and final state, a click of the button with return the switch to the first state, and turn off the light.

In alternative embodiments, the brightness levels may change in a different pattern, such as beginning in the brightest state, and decrementing back to the off state. Or, the states may be in any other pattern, including two or more states incrementing through one or more dimmed or intermediate brightness states to a maximum output state, and back through one or more dimmed or intermediate states. Unlike incandescent lamps, the LED maintains efficient power usage over a range of power levels with the visible brightness substantially proportional the power input. In addition, the LED maintains a consistent color temperature and appearance throughout the power range. In contrast, incandescent lamps tend to lose light output efficiency at dimmed levels at which more energy is radiated as non-visible heat, and the apparent color shifts toward the red end of the spectrum as power is reduced.

Figure 12:
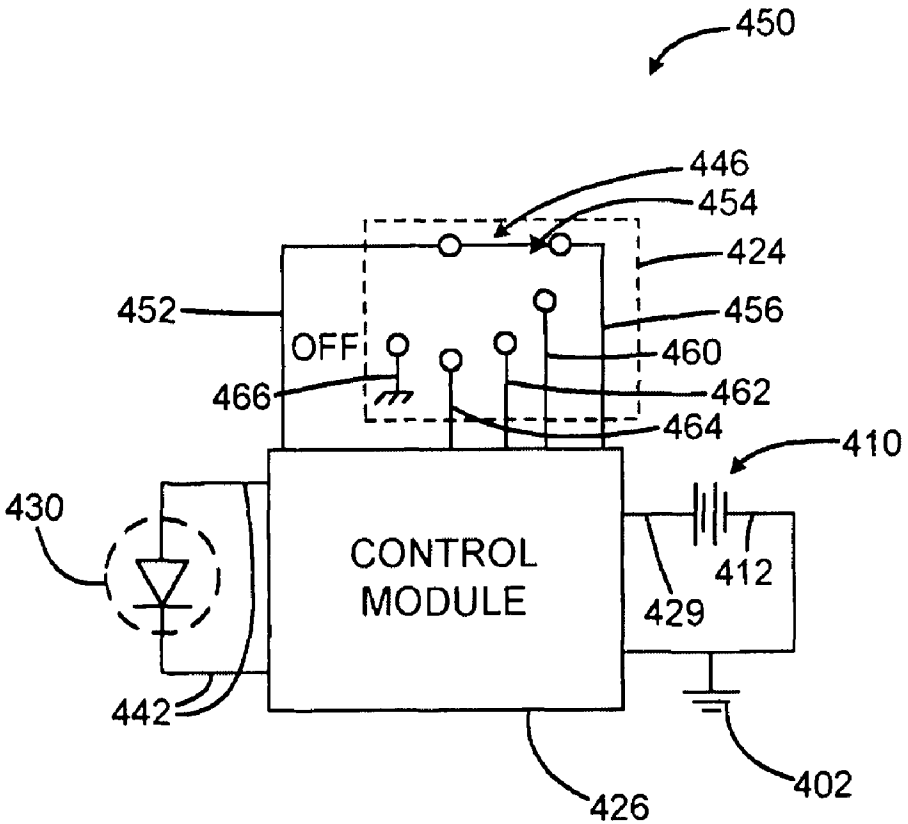
FIG. 12 is an electrical schematic diagram of the embodiment of FIG. 11.

FIG. 12 shows an electrical schematic 450. Both leads 442 of the LED 430 are connected to the controller, as are both terminals 412, 429 of the battery set 410. The switch 424 is shown with the spindle or rotor 446 having an input connection 452 connected to the controller, and having an electrical element 454 that sequentially contacts a series of contacts connected to the several output lines 456, 460, 462, 464. Each output line is connected to the controller, and a final contact is connected to a line 466 that is grounded to provide an off condition when the controller senses that the input line 452 is grounded. As the switch is clicked to increment the state, the rotor 446 schematically pivots to make contact with the next contact.

Figure 13:
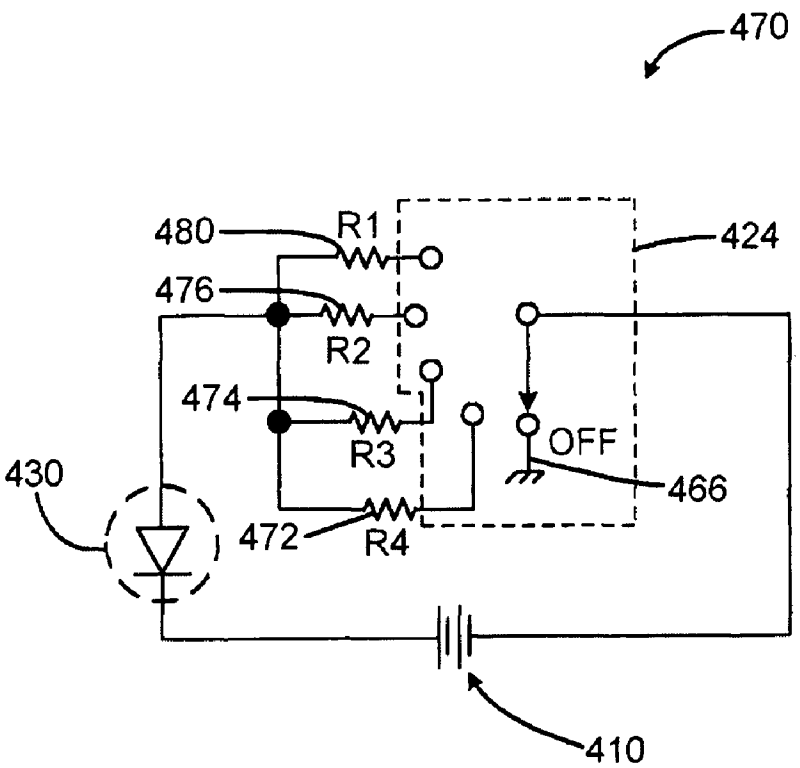
FIG. 13 is a sectional side view of a flashlight according to an alternative embodiment of the invention.

FIG. 13 shows an alternate electrical schematic 470 using the same switch 424, but without an electronic controller. Instead, all but the grounded output 466 and a direct line 480 are connected to a network of resistors 472, 474, 476, that are connected in parallel to the lamp in a simple loop circuit including the network, the lamp 430, and the battery 410. This embodiment serves to dim the output of the lamp when the switch is in a state in which current flows through a resistor, as opposed to a full brightness condition when the switch is connected to line 480. This embodiment, while simplified, does not provide efficient use of power at dimmed settings, but simply dissipates as heat in the resistors some of the energy that would have been emitted as light. The power consumption in the dimmed states is the same as in the max brightness state. Nonetheless, this may be useful for applications in which low manufacturing cost is a priority, and in which dimmed operation is relatively rare.

Variable Color Embodiment

Figure 14:
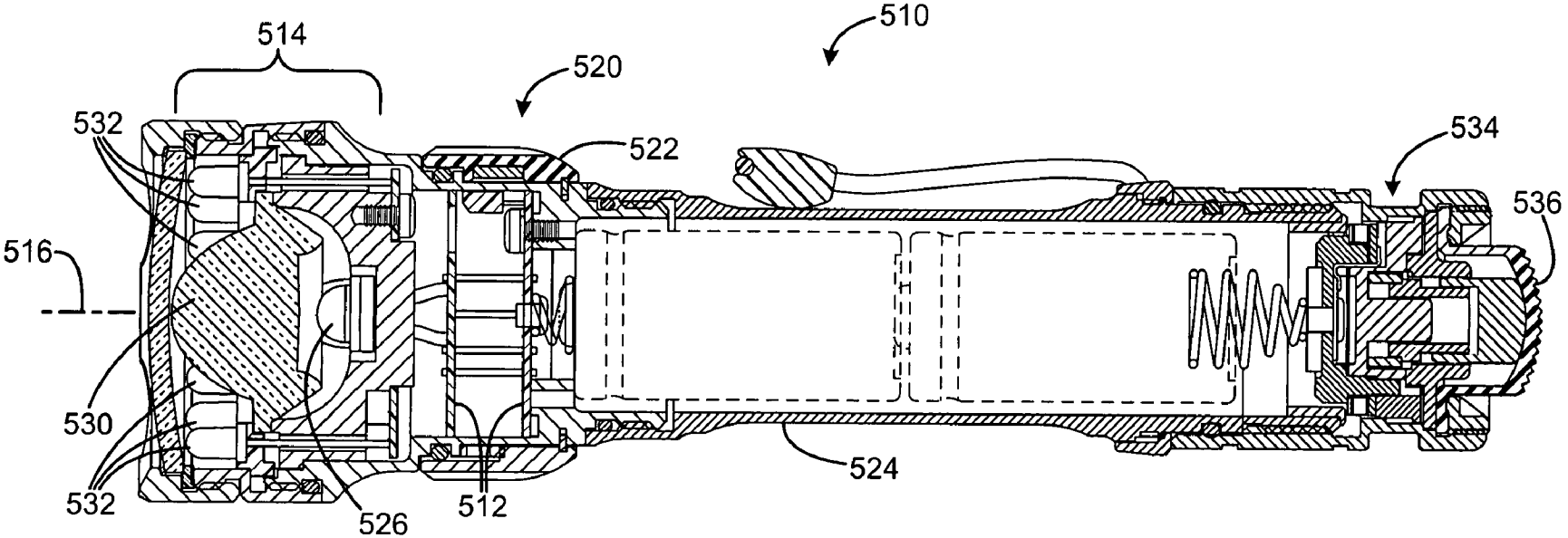
FIG. 14 is a sectional side view of a flashlight according to a further alternative embodiment of the invention.

FIG. 14 shows a flashlight FIG. 6 shows a flashlight 510 that is essentially the same in many respects as that shown in FIG. 6, with an output control 520 in the form of an annular ring 522 that encircles the periphery of the flashlight's housing 524 at the forward portion that houses a lamp assembly 514. The ring is oriented in a plane perpendicular to the flashlight housing and optical axis 516, and are concentric with the cylindrical housing portion. As illustrated schematically in FIG. 6, the ring includes an embedded magnet facing toward the center of the ring, and the flashlight includes a plurality of Hall effect magnetic field sensors that operate to detect whether or not the magnet is adjacently positioned. The sensors are connected to the control circuit 512, which receives a signal to determine the angular position of the ring at any time. The sensors may be configured as discussed and illustrated above with respect to FIGS. 6 and 7. With this arrangement, the control circuit operates to detect the absolute position of the ring.

The lamp assembly 514 includes a primary lamp 526, preferably in the form of a high-intensity LED with a white light output, and the capability to operate at a range of brightness based on supplied power levels. An LED is different from incandescent bulbs in that it is efficient at a wide range of different voltages. This means that the visible light output remains proportional to the power consumed by an LED. In contrast, an incandescent will lose light output at lower voltages, and moa higher proportion of energy dissipates at longer invisible wavelengths as heat. An LED may thus be describes as an "efficiently variable" or "efficiently adjustable" light source.

A lens 530 has refractive and reflective surfaces that generally collimate rays emitted in all directions by the LED, and send them on generally parallel paths as a beam directed along the axis 516. The lamp assembly also includes an annular array of separate secondary LED lamps 532 that surround the lens. Each such lamp has a lens that directs light from an LED within the lamp in a beam pattern parallel to the axis 516. In the preferred embodiment there are sixteen secondary lamps, with four of each of four different color or output wavelength. Note that a lamp may emit over a range of wavelengths, and the term output wavelength is used to indicate a dominant or apparent color wavelength. The color of the lamps may be selected for particular applications. Color/wavelength options include white, red, blue, green, amber, infrared, and any other electromagnetic emission wavelength emitted from compact solid state devices such as LEDs. This may also include microwaves, radio frequencies, and ultraviolet wavelengths that may have utility for certain military applications.

Figure 15:
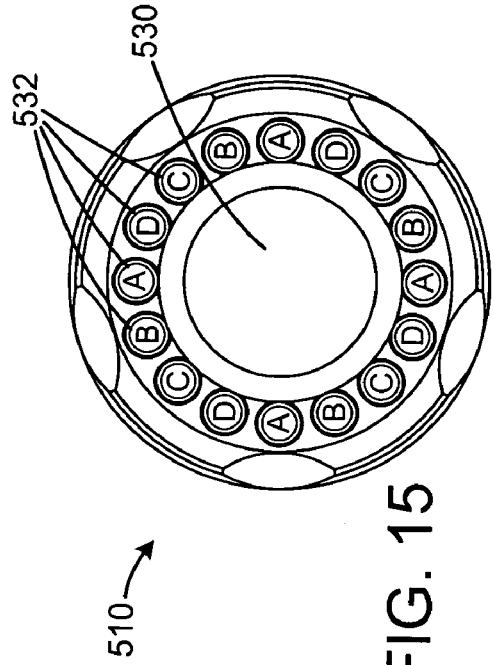
FIG. 15 is an axial end view of the flashlight of FIG. 14.

In the preferred embodiment the four different colors of secondary lamps are arranged in alternating fashion as shown in FIG. 15, so that lamps of color "A" (and each of colors B, C and D) are arranged in a square, to provide a generally axially balanced beam pattern when a single color set of lamps is illuminated alone. The sequence proceeds around the ring of secondary lamps: ABCDABCDABCD-ABCD. In alternative embodiments employing different numbers of lamps or different numbers of colors, the arrangement is preferably one of alternating distribution in this manner.

In further alternative embodiments all the secondary lamps may be of the same color, or there may be two, three or more than four different colors, with the number of colors limited only by the number of lamps. In other alternative embodiments, the large central lamp 526 and lens 530 may be omitted, and an array of the smaller secondary lamps closely arranged within the flashlight bezel to provide a compact configuration offering several different lamp colors. In further alternatives, there may be several separately-addressable different color emitters within a single lamp, or behind a single lens to provide multiple color capability. For instance, instead of an array of secondary lamps surrounding lens 530, there may be several lamps positioned behind the lens, adjacent to the primary lamp 526. These may be off the optical axis of the lens, and thus generate less collimated beam patterns. However, they may be useful for general illumination where a compact bezel is desired.

The flashlight 510 includes a second tail cap switch 534. In the preferred embodiment, the switch has a two-stage contact. The contact is connected to a rear button 536 that may be pressed through a range of axial motion. The tail cap is connected to the body 524 by helical threads that allow positioning of the switch contact in an axial direction based on the rotational position of the tail cap. In a standard condition, there is no connection made within the switch when no pressure is applied to the spring biased button. When an intermediate pressure is applied and the switch depressed an intermediate distance, a first contact is made. When a greater or full pressure or displacement is applied, a second contact is made. With the switch connected to the circuitry 512, the circuitry is able to determine the condition of the switch contacts. In alternative embodiments lacking complex circuitry, the contacts may provide direct power to different lamp elements to provide different operation modes.

The tail cap switch may also be rotated to move away from the body to a fully or partially locked out condition in which one or both of the contacts are prevented from making contact even under application of pressure on the button. The tail cap switch may be rotated to move toward the body to a partially locked-on position in which the first contact is made when there is no pressure applied to the button (which allows the second contact to be made in response to pressure.) The tail cap switch may be rotated to move toward the body to a fully locked-on position in which the both contacts are made when there is no pressure applied to the button.

An alternative click-on click-off tail cap switch may employ the above basic functions, except that unlike the standard switch that reverts to the released position when pressure is removed from the button, it allows the user to momentarily apply pressure to click on the switch to a selected condition.

With the tail cap in a standard rotational position, no contact is made before the button is pressed. Moderate pressure to a first point makes the first contact, and additional pressure to a second point makes the second contact as well. Further pressure to a third point ratchets an internal "click" mechanism that keeps both contacts made when pressure is released. A subsequent application of pressure past the third point allows the mechanism to ratchet to "click off" and allow the contacts to be broken when pressure is released.

In this alternative embodiment of the tail cap switch, with the tail cap rotated away from the body to a first partially locked out position, the contacts are open initially without pressure applied. As pressure is applied, the first contact is made, then the second contact. Further pressure activates the click mechanism, However, in contrast to the standard rotational position, the slight release of pressure as the click mechanism restrains the contacts allows the second contact to break while the first is still made.

In a second partially locked out position with the tail cap further rotated away, the first contact may be made when in a clicked on condition, but the second contact is fully locked out even under maximum pressure.

In a third partially locked out position with the tail cap further rotated away, the first contact may be made in response to full pressure, but there is no contact made in the clicked-on condition.

In a first partially locked on position in which the tail cap is rotated toward the body a first amount, the first contact is made when the switch is released, regardless of the clicked condition. Additional pressure and the clicked on condition make the second contact as well.

In a second fully locked on position both contacts are made regardless of switch pressure of click condition.

The ring 522 serves to allow the user to establish a state for operation of the flashlight, within a range of discreet options corresponding to the number of sensors. In alternative embodiments employing analog instead of digital technology, a linear or continues input may be provided, instead of discrete digital steps. In the preferred embodiment, the ring establishes which of the secondary lamps (and/or primary lamp) will be illuminated when only the first contact is made in the tail cap switch.

In the preferred embodiment, the ring rotates through five different positions. Four correspond to the four different colors of secondary lamps, and one corresponds to the primary lamp, in a dimmed illumination level. Thus, in many of the tail cap positions discussed above, the user may select the preferred color (including white primary light at a dimmed level) for intermediate switch pressure, with the bright central light being fully illuminated with full pressure (or by any of the other means to make the second contact.

While the preferred embodiment illuminates only one color of lamp at a time, in alternative embodiments, the lamps may be illuminated in different combinations, permutations, brightnesses, and ratios. For instance, to generate a range of colors within a spectrum, and in an embodiment in which red, green, and blue (RGB) secondary lamps are employed, with letters representing the number of illuminated lamps, colors may be provided by RRRR (pure red), RRRG, RRGG (yellow), RGGG, GGGG (pure green), GGGB, GGBB (cyan), GBBB, BBBB (pure blue), BBBR, BBRR (magenta), and BRRR. Additional permutations may be provided by driving different lamps at different brightnesses, and mixing in white light to desaturate the net output. Any function, pattern, or sequence of lighting conditions that may be linearly expressed in correspondence with the rotational position of the ring may be selected, as the control circuitry may be programmed to illuminate any lamp at any level in any position. The ring control switch may also be used to combine the brightness function discussed above in conjunction with the single-lamp embodiment, with the addition of other colors. For instance, the first several positions may corresponding to the different color secondary lamps, and a remaining range of rotation corresponding to a range of intermediate brightness levels of the primary white lamp.

In a further alternative embodiment, the color-controlling ring switch may be used on conjunction with a side button switch such as disclosed in FIG. 11, with the side button switch being one of either type discussed above as a tail cap switch, or an incrementing switch that increments between a plurality of conditions. In the latter case, the ring function may be different for each of the different selected incremented position, such as one mode in which the ring establishes net color output, another in which the ring establishes brightness, etc.

This disclosure is made in terms or preferred and alternative embodiments, and is not intended to be so limited.

The invention claimed is:

1. A flashlight comprising:

a first lamp having a first output wavelength;

a second lamp having a different second output wavelength;

a power storage element;

a first switch having a first condition in which the first lamp is in an enabled state, and a second condition in which the second lamp is in an enabled state;

a second switch operable to illuminate any lamp that is in an enabled state;

wherein the second switch has an off position, an intermediate position, and a fully actuated position, and wherein the first switch operates to limit illumination to only one of the lamps when the second switch is in the intermediate position; and wherein the first lamp operates with at least two different brightness levels, and wherein when the first lamp is enabled by the first switch and the second switch is in the intermediate position, the first lamp operates at a dimmed brightness level, and wherein when the first lamp is enabled by the first switch and the second switch is in the fully actuated position, the first lamp operates at a brighter brightness level.

2. The flashlight of claim 1 wherein the first lamp operates with at least two different brightness levels, and the second switch is operable to sustain illumination of the first lamp at a brighter of the levels in response to momentary actuation of the second switch to the fully actuated position, and a release from the fully actuated position.

3. The flashlight of claim 1 wherein the flashlight has a body with a central axis, and wherein the first lamp is oriented on the axis and has a substantially white light, and wherein the second lamp is positioned off-axis.

4. The flashlight of claim 3 wherein the second lamp is a member of a set of lamps arranged annularly about the first lamp.

5. The flashlight of claim 4 wherein the set of lamps includes at least two different output wavelengths.

6. The flashlight of claim 1 wherein the second lamp has an infra red output wavelength.

7. The flashlight of claim 1 including a third lamp having a different output wavelength compared to the first and second lamps, and wherein the first switch has a third condition operable to enable the third lamp while disabling the first and second lamps.

8. The flashlight of claim 1 wherein the first switch is an annular switch movable through a range of positions.

9. The flashlight of claim 8 wherein the flashlight is an elongated body having a front end at which the lamps are mounted and an opposed rear end, and wherein the first switch is a ring encircling the body adjacent to the front end.

10. The flashlight of claim 9 wherein the second switch is positioned at the rear end of the body.

11. A flashlight comprising:

an elongated body having opposed first and second ends;

a first lamp comprising a high-intensity efficiently variable brightness white light source at the first end;

a plurality of additional lamps at the first end;

the additional lamps including at least two different output wavelengths different from each other and from the first lamp;

a single first switch on the flashlight having a plurality of conditions and selectively operable to select the output wavelength of the flashlight by selectively enabling different lamps based on the condition of the switch;

a power storage element and control circuitry operably connected to the lamps and to the switch;

the flashlight including a second switch having an off position, an intermediate position, and a fully actuated position;

the first lamp being operable at a first dim brightness level, and a second maximum brightness level;

the first lamp being illuminated at the second brightness level when the second switch is in the fully actuated position; and when the second switch is in the intermediate position, the illumination being provided by at least one of:

the first lamp at the first brightness level; and at least a selected one of the additional lamps.

12. The flashlight of claim 11 wherein additional lamps surround the first lamp.

13. The flashlight of claim 11 wherein the first switch is a rotatable ring encircling the body.

14. The flashlight of claim 11 wherein the white light source is an LED.

15. A flashlight comprising:

a first lamp having a first output wavelength;

a second lamp having a different second output wavelength;

a power storage element;

a first switch having a first condition in which the first lamp is in an enabled state, and a second condition in which the second lamp is in an enabled state;

a second switch operable to illuminate any lamp that is in an enabled state;

wherein the first lamp operates with at least two different brightness levels, and the second switch is operable to sustain illumination of the first lamp at a brighter of the levels in response to momentary actuation of the second switch to the fully actuated position, and a release from the fully actuated position; and a third lamp having a different output wavelength compared to the first and second lamps.

16. The flashlight of claim 15 wherein the flashlight has a body with a central axis, and wherein the first lamp is oriented on the axis and has a substantially white light, and wherein the second lamp is positioned off-axis.

17. The flashlight of claim 16 wherein the second lamp is a member of a set of lamps arranged annularly about the first lamp.

18. The flashlight of claim 17 wherein the set of lamps includes at least two different output wavelengths.

19. The flashlight of claim 15 wherein the second lamp has an infra red output wavelength.

20. The flashlight of claim 15 wherein the first switch has a third condition operable to enable the third lamp while disabling the first and second lamps.

21. The flashlight of claim 15 wherein the first switch is an annular switch movable through a range of positions.

22. The flashlight of claim 21 wherein the flashlight is an elongated body having a front end at which the lamps are mounted and an opposed rear end, and wherein the first switch is a ring encircling the body adjacent to the front end.

23. The flashlight of claim 22 wherein the second switch is positioned at the rear end of the body.

* * * * *